US006898915B2

(12) United States Patent
Hancock

(10) Patent No.: US 6,898,915 B2
(45) Date of Patent: May 31, 2005

(54) REINFORCEMENT BAR SUPPORT DEVICE

(76) Inventor: Kevin Hancock, 6712 E. Kentucky Ave., Anaheim Hills, CA (US) 92807

( * ) Notice: Subject to any disclaimer, the term of this patent is extended or adjusted under 35 U.S.C. 154(b) by 0 days.

(21) Appl. No.: 10/236,850

(22) Filed: Sep. 7, 2002

(65) Prior Publication Data

US 2004/0045251 A1 Mar. 11, 2004

(51) Int. Cl.[7] ..... E04C 5/16
(52) U.S. Cl. ..... 52/677; 52/687; 52/688; 52/699; 249/3
(58) Field of Search ..... 52/677, 687, 688, 52/699; 249/3

(56) References Cited

U.S. PATENT DOCUMENTS 4,063,397 A * 12/1977 Follows ..... 52/684
5,216,866 A * 6/1993 Ekedal ..... 52/677
5,337,534 A * 8/1994 Nasca ..... 52/745.21
5,375,941 A * 12/1994 Strobl, Jr. ..... 404/7
5,688,428 A * 11/1997 Maguire ..... 249/91
6,021,994 A * 2/2000 Shartzer, Jr. ..... 249/6
6,578,814 B2 * 6/2003 Hoyle et al. ..... 249/3

* cited by examiner

*Primary Examiner*—Brian E. Glessner
*Assistant Examiner*—Steve Varner
(74) *Attorney, Agent, or Firm*—Hung Tran

(57) ABSTRACT

A re-bar support device comprising a base board and re-bar holders to hold a plurality of re-bars spaced to fit into the holes of the hollow blocks used to build a block wall. The re-bar support device attaches to vertically standing stakes. Several re-bar support devices may be interconnected to cover the desired length of the foundation of the wall. The re-bar support device proposes several methods for easily introducing a re-bar to a re-bar holder and also discloses modifications on the internal side of the body of the re-bar support device to allow a better grip on the re-bars while concrete is poured around them during the formation of the foundation for the wall.

5 Claims, 5 Drawing Sheets

REINFORCEMENT BAR SUPPORT DEVICE

BACKGROUND

The present invention relates to an apparatus for supporting vertical steel reinforcement bar (re-bar) of various diameters during the pouring of a concrete foundation for a wall using a base board with holders attached to the base board. The holders holding the re-bars are positioned in such a way that the re-bars would allow the hollow concrete blocks to fit over them during the construction of the wall.

In a typical wall construction project, a ditch must be dug out. The ditch is then filled with concrete cement forming the foundation for the wall. Hollow blocks are then set on the foundation, and cemented. Concrete is poured into the hollow block to provide strength. However, in order for the wall to be structurally sound, re-bars originating from the foundation and extending upwards into the wall, must be placed. Typically, the steps taken to construct a block wall is as follows:

A ditch extending into the ground is dug to house the foundation of the wall. Re-bars are suspended off the ground and are individually wired to a wooden board by steel tie wires. The re-bars extend into the ditch and are spaced and aligned in such a way that the apertures on the hollow blocks allow the re-bars to go through the interior of the hollow blocks which form the wall. With the re-bars hanging from the wooden board, concrete is poured into the ditch. A foundation is formed when the concrete hardens. The wooden board is removed by first cutting the steel tie wires. As the concrete hardens around the re-bars, they become firmly held by the foundation. Hollow blocks are lowered down over the vertical re-bars, cemented and set upon the foundation to create a wall. Concrete is poured down the hollows blocks to reinforce and form a strong wall and the re-bars in the blocks provides the additional strength for the wall. The traditional way of constructing a wall using the steel tie wire requires a person to hold the re-bar while it is being tied to the wooden board. The positions of the re-bars have to be measured and marked on the wooden board. This process is time consuming. An improved way of avoiding the steel tie wires is disclosed in U.S. Pat. No. 5,688,428. While this method did away with the use of steel tie wires, it still requires the traditional wooden board and measurements for the re-bar holders on the wooden board. Another method as shown in U.S. Pat. No. 6,161,360 requires a penetrable cover for the re-bars. U.S. Pat. No. 5,371,991 propose the use of C-shaped holders on a wooden board to avoid using the steel tie wires.

It is therefore an objective of this invention to provide a simple device, where one worker can quickly suspend and hold the re-bars in place while concrete is poured into the ditch to create a foundation. It is also an objective of this invention to provide an easy way for a worker to either slide or snap the re-bar into a re-bar holder. It is a further object of this invention to provide a way to interconnect several re-bar support devices to cover the desired length of the foundation of the wall.

SUMMARY OF THE INVENTION

The present invention is a device designed to help a construction worker to efficiently suspend re-bars over a ditch at the precise locations where the hollow blocks are to be lowered to form a block wall.

This device comprises a base board preferably but not necessarily hollow, with re-bar holders attached to the base board. The hollow base board has a top surface, a first wall, a bottom surface, a second wall, a first end and a second end, the top and bottom surface having a top and bottom apertures aligned to accommodate a stake through said top and bottom apertures; a plurality of re-bar holders attached to one or a combination of the walls of the base board; and, means for connecting the stake to the base board. The stake has two ends with one bottom end being sharp to penetrate into the ground and connects to the base board through a pin. Several stakes are usually needed to support and to suspend the hollow base board horizontally. The pin penetrates through a hole of a side surface of the base board, the hole on the stake and through another hole on the other side surface of the base board.

One unique feature of this device is the provision of connectors on the lateral ends of the base board to connect one base board of one re-bar support device to another base board of a re-bar support device if more than one base board is needed to cover a desired length of a foundation for a block wall.

Another unique feature of this apparatus is in its re-bar holders. The re-bar holder has a body, a top aperture, a bottom aperture and a side aperture. A guide may be attached to the bottom aperture of the body of the re-bar holder, the guide having a first diameter the same as the diameter of the bottom aperture and a second diameter bigger than that of the bottom aperture with a side cut off to attach or protrude from the first wall of the base board. The guide may also have a guide aperture cut out from the side of the guide facing away from and opposite the first wall.

The body of the re-bar holder, to form a stronger grip of the re-bar, may have a plurality of saw-tooth blades extending into the top of the body of the re-bar holder or may have an array of buttons embedded into the inside wall of the body. The re-bar holder may also incorporate a side guide shaped like an elongated half circular cylinder extending along the side aperture, the side aperture being cut off by the body with adequate spacing to easily snap a re-bar into the re-bar holder.

A process of constructing a foundation for a wall having a re-bar for reinforcement using the above device comprises digging a ditch having enough space to accommodate a foundation for a wall; installing a stake at each lateral end of a base board extending over a desired length of the foundation; suspending the base board on the stakes through a pin connecting each lateral end of the base board to the stake; sliding or snapping a required number of re-bar into a series of re-bar holder; pouring concrete into the ditch and allowing the concrete to harden to form the foundation; and, removing the base board off the re-bars. If the length of the desired foundation is longer than one base board, several base boards may be connected in series to each other to cover the desired length of the foundation before or after suspending the lateral ends of the base board corresponding to each end of the foundation on their respective stakes through the pin. The base board of the re-bar support device are suspended prior to putting the re-bars on the re-bar holders.

DETAILED DESCRIPTION OF THE INVENTION

Figure 1:
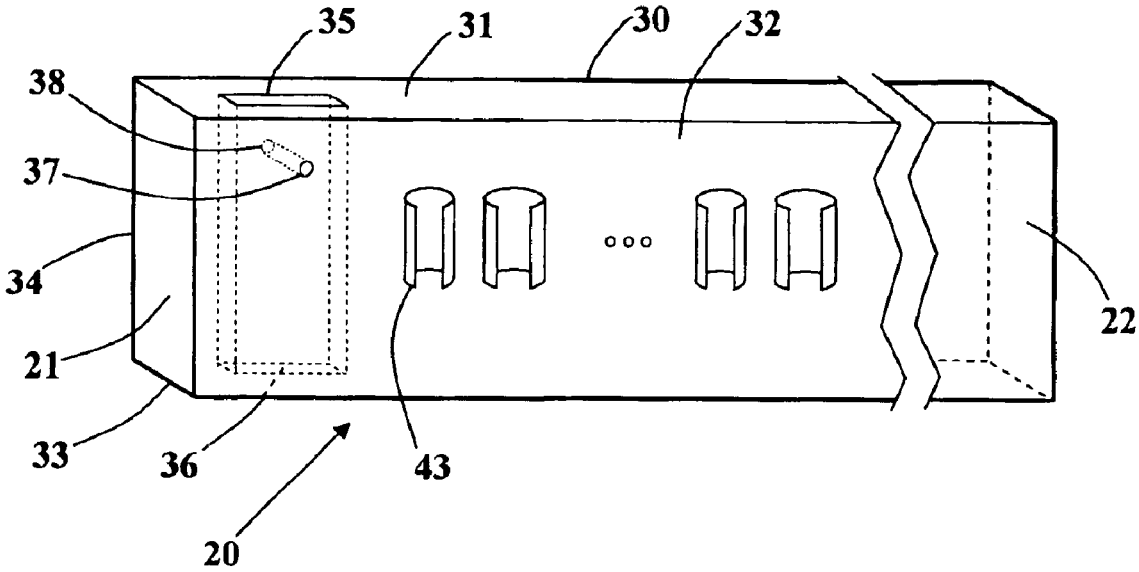
FIG. 1 is a perspective view of the re-bar support device.
Figure 2:
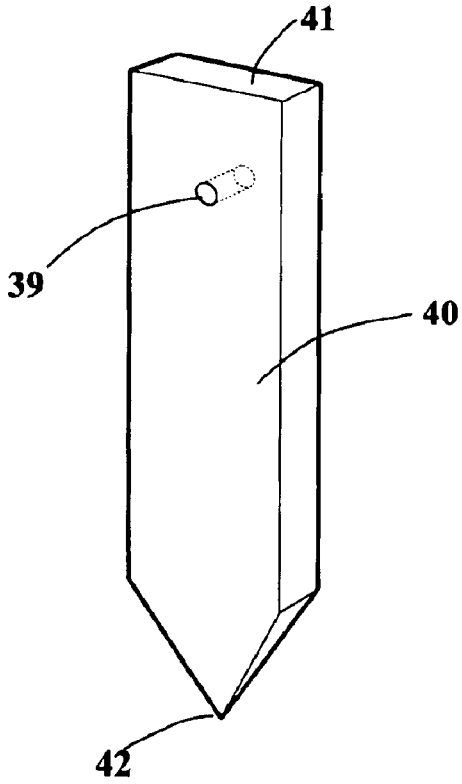
FIG. 2 is a perspective view of a stake.
Figure 9:
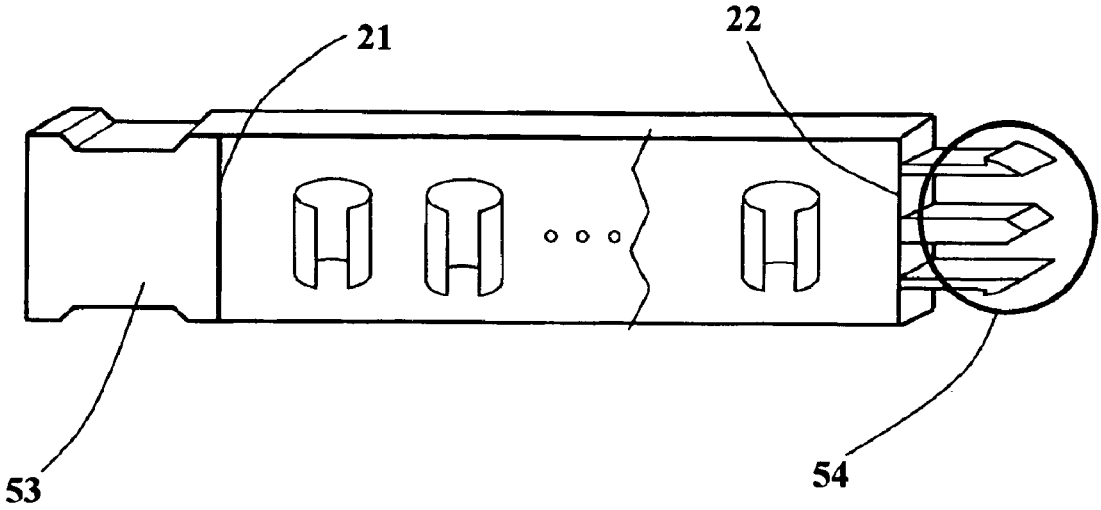
FIG. 9 is a perspective view of the spade female and male connectors on the base board.
Figure 10:
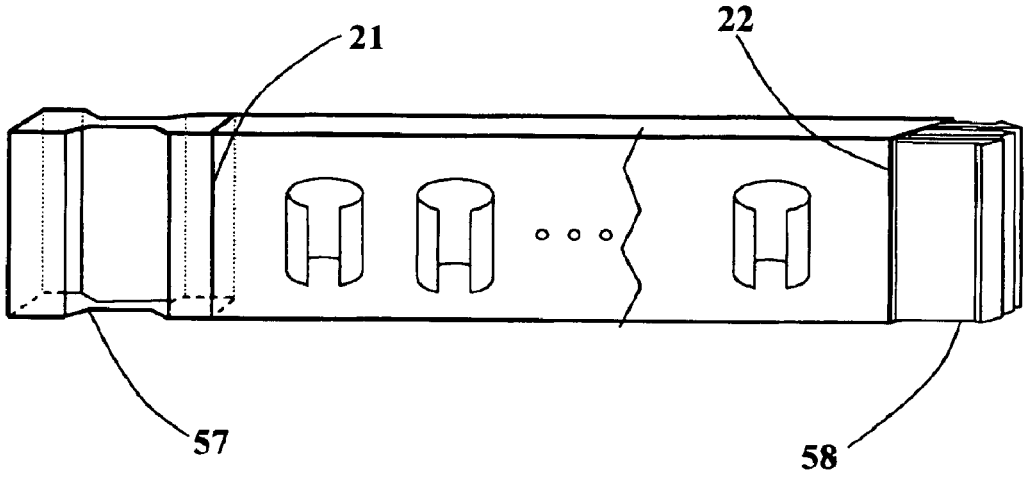
FIG. 10 is a perspective view of another connector with the spade female and male connectors of FIG. 9 rotated by 90 degrees.

FIG. 1 illustrates the re-bar support device 20 on a base board 30. The base board 30 is hollow, preferably but not essentially made of plastic material, having a top surface 31, a first wall 32, a bottom surface 33, and a second wall 34. On the top surface 31 and the bottom surface 33 are apertures 35 and 36, usually but not essentially of rectangular shape, carved out to allow a stake 40 shown in FIG. 2 to go through these apertures. The stake 40 has a top end 41 and a sharp bottom end 42 and its shape conforms with the shape of apertures 35 and 36. Commercially available stakes are usually made of metal and are 1½ inches wide and ⅜ inch thick having a plurality of holes or apertures along the length of the stake. However, only one aperture 39 is sufficient to hold one stake to the re-bar support device 20. The aperture 39 approximately 1¼ inch from the top end 41 of the stake as shown in FIG. 2 is usually chosen for the device 20 described. The stake illustrated herein only has one aperture. The stake 40 is placed through the top surface 31 and the bottom surface 33 of the device 20 through apertures 35 and 36. On the first wall 32 and the second wall 34 are apertures 37 and 38, usually round, aligning with each other to allow a pin 55 (not shown) to pass through the first round aperture 37 through the aperture 39 on the stake 40 and then through the second round aperture 38. The pin 55 attaches the base board 30 to the stake 40. The base board 20 has two lateral ends, a first end 21 and a second end 22. The bottom 42 of the stake penetrates into the ground. One stakes 40 is used for each lateral ends, 21 and 22 of the base board 30 for support. Re-bar holders 43 of different sizes are attached on or protrudes from one wall or a combination of the walls of the base board 30. A plurality of these re-bar holders are at pre-measured positions so as to fit the apertures on the blocks used to construct a wall. The re-bar holder may extend through the width of the wall to which it is attached (not shown) or may be shorter as shown in FIGS. 1, 9 and 10. The base board 30 may have the re-bar holders attached at fixed position to fit a particular sized hollow blocks or may have a plurality of holes through which a re-bar holder may attach to depending upon the type and size of the hollow blocks to be used. The latter will allow the use of the same base board for different types of hollow blocks. The re-bar holders can be attached to the holes on the base board by several means known in the art.

Figure 3:
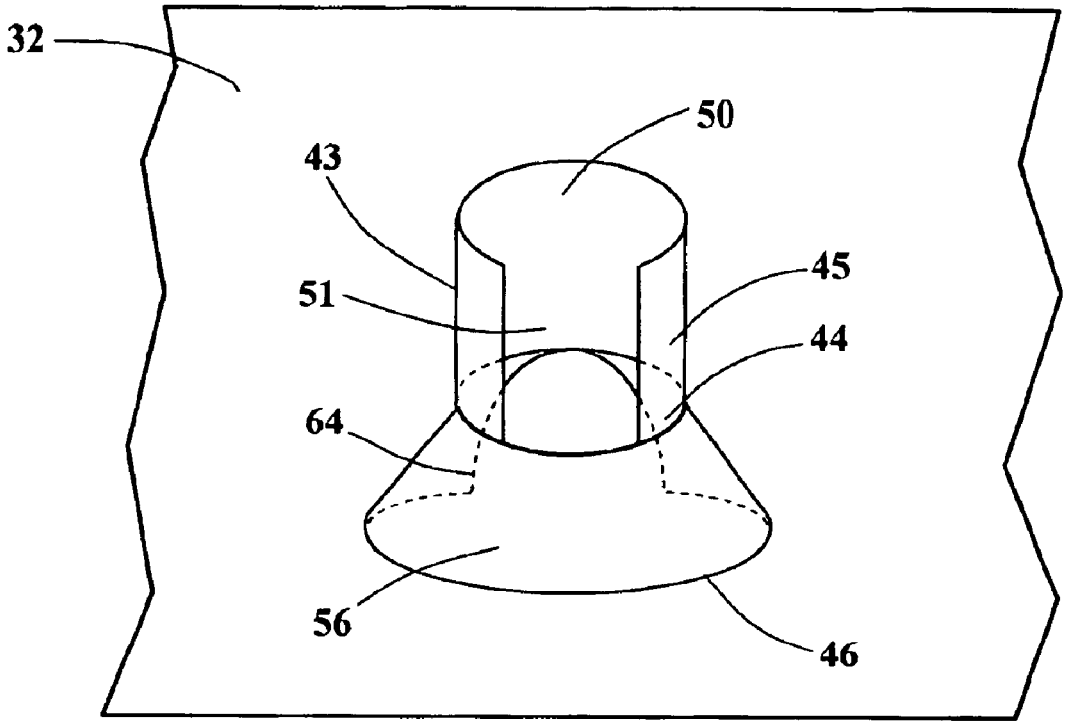
FIG. 3 is a perspective view of the first re-bar holder.
Figure 4:
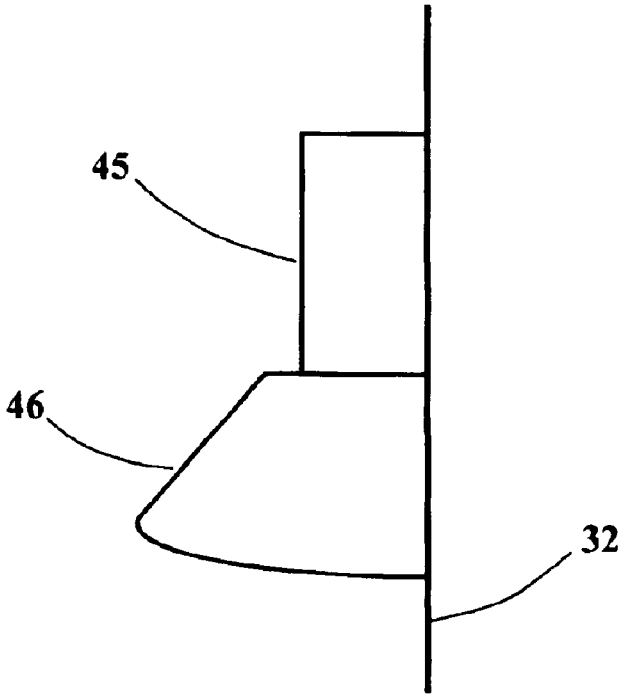
FIG. 4 is a side view of the re-bar holder of FIG. 3.

FIGS. 3 through 8 illustrate the various shapes of the re-bar holders. All the re-bar holders have a geometric shape conforming with the shape of the re-bar, herein shown as cylindrical for a cylindrically shaped re-bar. The re-bar holder 43 has a body 45, a top aperture 50, a bottom aperture 44, and a side aperture 51. The internal diameters of the top aperture 50 of the re-bar holders 43 are varied and selected to correspond to the outside diameters of the various re-bars. The re-bar holders 43 are preferably made of a plastic material or a resilient metal to frictionally hold and suspend the re-bar during the concrete pouring stage. The side aperture 51 of the body 45 is sized so that a re-bar can be snapped into the re-bar holder. The re-bar illustrated in FIG. 3 has a guide 46, preferably conical in shape. The conical guide 46 has two diameters. The first diameter of the conical guide 46 is the same as the diameter of the bottom aperture 44 of the body of the re-bar holder 43 and is attached to the bottom of the body of the re-bar holder 43. The second diameter 56 of the re-bar conical guide 46 is slightly bigger than those of the re-bar apertures 44 and 50 of the re-bar holder 43 to allow a re-bar to easily slide into the re-bar holder 43 from the bottom aperture 44 and upwards toward the body 45 of the re-bar holder 43. The conical guide 46 is attached to or protrudes from the base board 30 and is cut off by the first wall 32 of the base board 30 as shown in FIG. 4.

Figure 5:
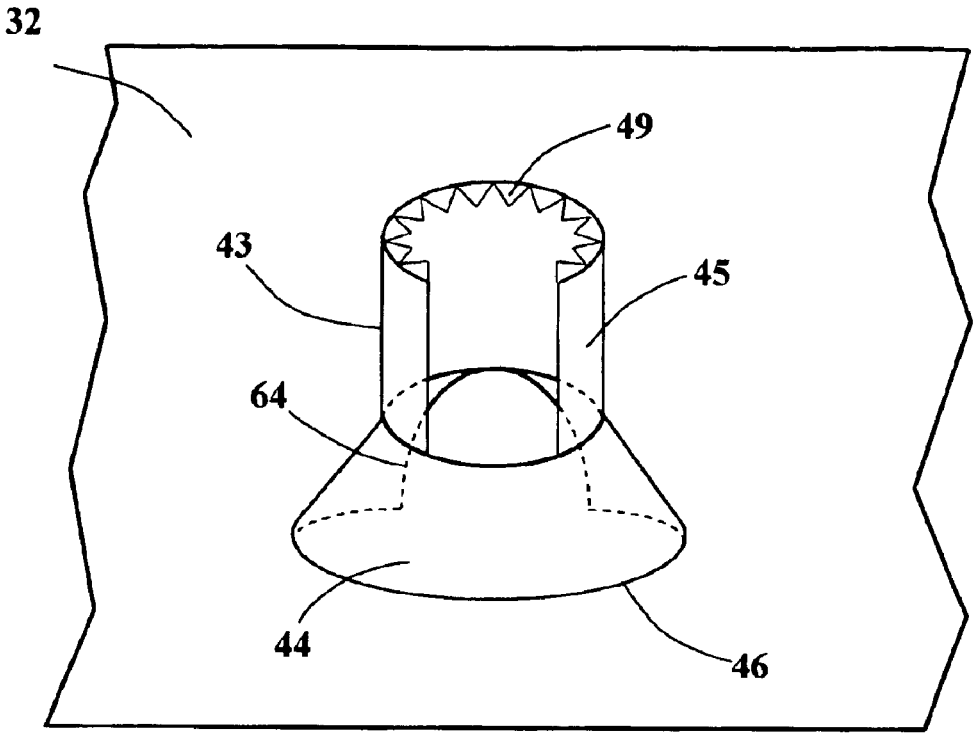
FIG. 5 is a perspective view of the second re-bar holder.

FIG. 5 illustrates a plurality of saw-tooth blades 49 extending into the top of the body 45 of the re-bar holder covering part of the top aperture 50 of the re-bar holder 43. The purpose of the plurality of saw-tooth blades 49 is to provide more friction to the re-bar holder 43, to keep the re-bar from sliding downward once it is inside the re-bar holder.

Figure 6:
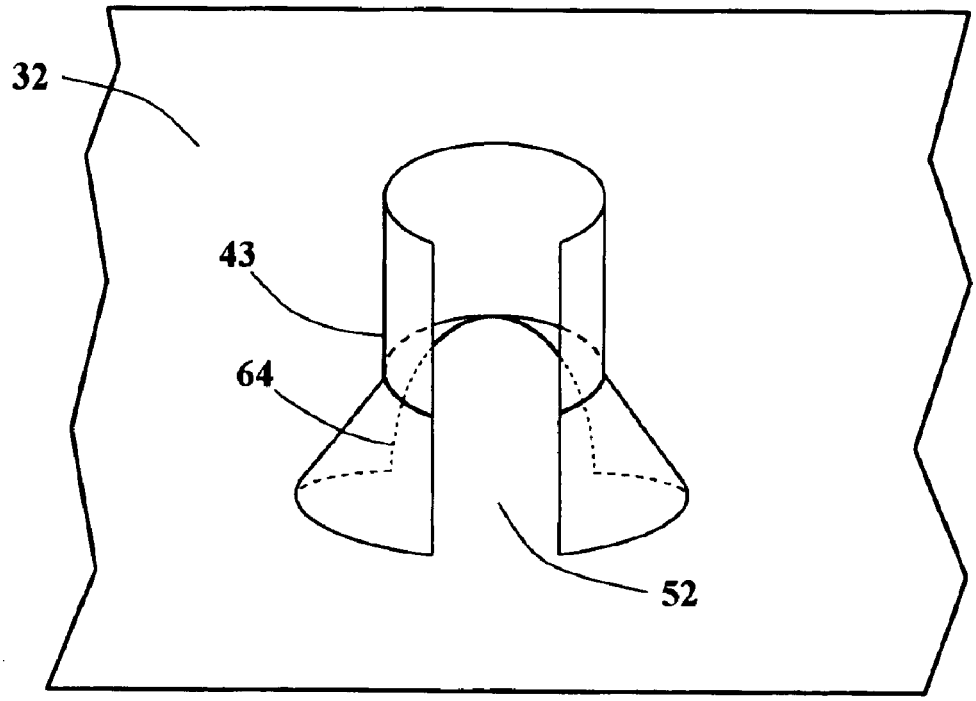
FIG. 6 is a perspective view of the third re-bar holder.

FIG. 6 illustrates a modification of the re-bar holder shown in FIG. 3 where a guide aperture 52 is cut out from the side of the conical guide 46 facing away from the first wall 32.

Figure 7:
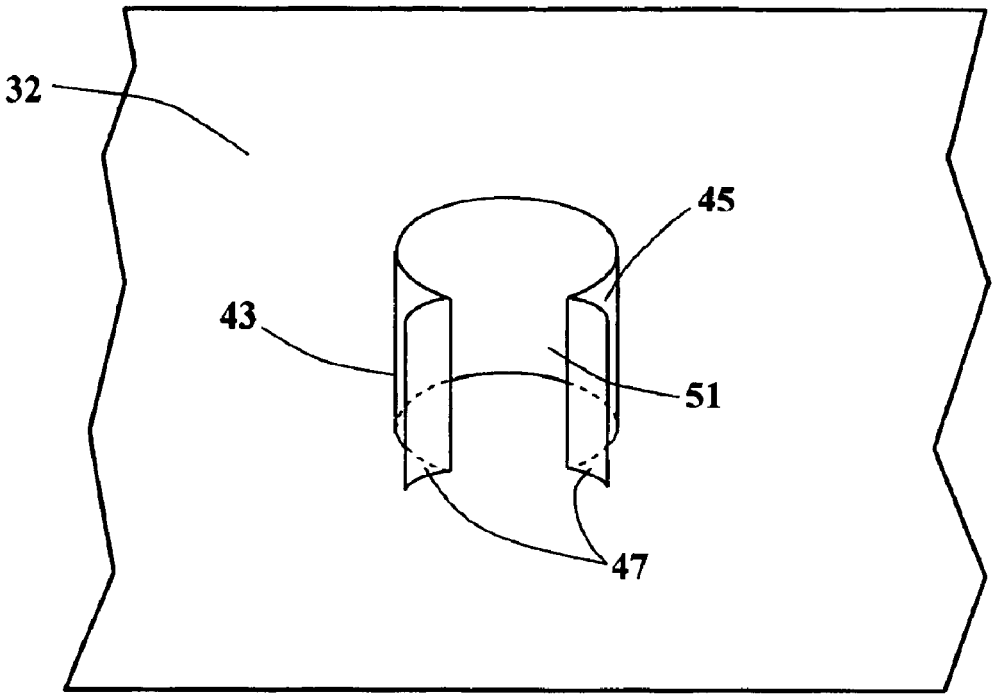
FIG. 7 is a perspective view of the fourth re-bar holder.

FIG. 7 shows a re-bar holder without the conical guide 46 but incorporates a side guide 47 attached to the body 45 of the re-bar holder 43 through the side aperture 51. The re-bar side guide 47 is shaped like an elongated half circular cylinder extending along the side aperture 51, the side aperture being cut off by the body 45 with adequate spacing so that a re-bar, when placed into the side guide 47, would be easily snapped into the re-bar holder.

Figure 8:
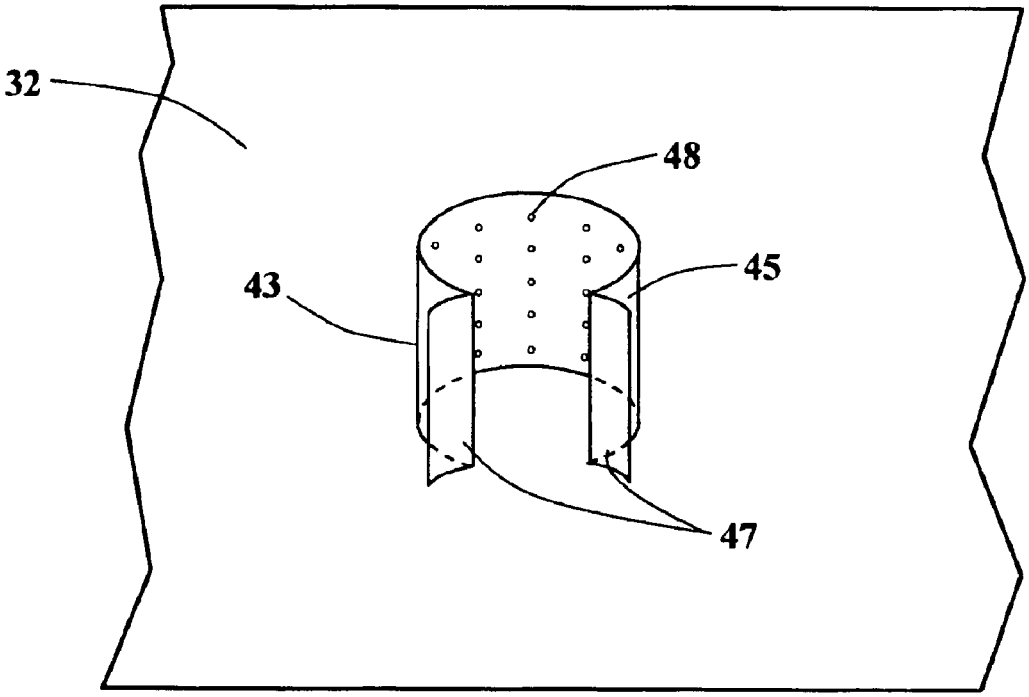
FIG. 8 is a perspective view of the fifth re-bar holder.

FIG. 8 illustrates a modification of FIG. 7 whereby an array of buttons 48 is embedded into the inside wall of the body 45 of the re-bar holder 43. The buttons may have different geometric shapes, cubical, partial sphere, a 3 dimensional square, a 3 dimensional rectangle or a pyramid. The purpose of the array of buttons 48 is to create more friction so that the re-bar would be suspended and held firmly once it is slid or snapped into the re-bar holder.

FIG. 9 illustrates the re-bar support device 20 having a spade female connector 53 and a male connector 54 attached to the two respective ends 21 and 22 of the base board 30. A second re-bar support device 20 may be connected by fitting the male connector 54 of one re-bar support device into the female connector 53 of another re-bar support device. A third re-bar support device or more support devices may be connected in the same manner depending upon the length of the wall desired. Other connecting mechanisms aside from that shown in FIG. 9 may be used such as rotating male connector 54 and the female connector of 53 of the connecting mechanism by 90 degrees. The rotated female connector 57 and the rotated male connector 58 are shown in FIG. 10.

Unless specifically stated, the re-bar support device 20 is preferably made of a rigid plastic material.

In operation, a ditch having enough space to accommodate the volume of the foundation for a wall is dug. Two stakes are pounded into the ground preferably above the ditch with the distance of the stakes determined by the length of the wall plus approximately half a foot of distance to each end of the wall. A base board 30 is then suspended on the two stakes by fitting the base board into the stakes through the aligned apertures 35 and 36 on the top surface 31 and the bottom surface 33 respectively. One lateral end 21 of the base board is connected to the first stake by using a pin 55, which is structurally sound to support the weight of the base board 30 and the re-bar holders 43. The pin is introduced through the aperture 37 on the first wall 32, the aperture 39 of the stake 40 and the aperture 38 of the second wall 34. The second lateral end 22 of the base board 30 is suspended on a second stake 40 using the same method. If the wall is longer than the length of the re-bar support device, several support devices can be connected to each other to cover the length of the wall. The re-bars, extending into the ditch, are then either slid or snapped into the holders 43 attached to the base board at predetermined positions to conform with the holes of the hollow block. Concrete is poured into the ditch and allowed to harden. After the concrete has hardened, the base board 30 is removed by removing the two pins 55 and stakes 40 and then either sliding the base board off the re-bars or un-snapping the base board holders from the re-bars.

While the embodiments of the present invention have been described, it should be understood that various changes, adaptations, and modifications may be made therein without departing from the spirit of the invention and the scope of the claims.

I claim:

1. A re-bar support device, comprising:

a base board having a top surface, a first wall, a bottom surface, a second wall, a first end and a second end, the top and bottom surface having a top and bottom apertures aligned to accommodate a stake through said top and bottom apertures;

a plurality of re-bar holders attached to one or a combination of the walls of the base board, the re-bar holders having a body, a top aperture, a bottom aperture and a side aperture; and, means for connecting the stake to the base board wherein said means is a pin.

2. The re-bar support device of claim 1 further comprising a guide attached to the bottom aperture of the body of the re-bar holder, the guide having a first diameter the same as the diameter of the bottom aperture and a second diameter bigger than that of the bottom aperture with a side cut off to attach or protrude from the first wall of the base board.

3. The re-bar support device of claim 2 wherein the guide has a guide aperture cut out from the side of the guide facing away from and opposite the first wall.

4. The re-bar support device of claim 1 wherein the re-bar holder incorporates a side guide shaped like an elongated half circular cylinder extending along the side aperture, the side guide being cut off by the body with adequate spacing to easily snap a re-bar into the re-bar holder.

5. The re-bar support device of claim 1 further comprising an array of buttons embedded into the inside wall of the body.

* * * * *